US007399129B2

(12) United States Patent
Writt

(10) Patent No.: US 7,399,129 B2
(45) Date of Patent: Jul. 15, 2008

(54) USER INTERFACE FOR A HAND-OPERATED PRINTER

(75) Inventor: John Thomas Writt, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 4 days.

(21) Appl. No.: 11/312,105

(22) Filed: Dec. 20, 2005

(65) Prior Publication Data

US 2007/0140770 A1 Jun. 21, 2007

(51) Int. Cl.

| | |
|---|---|
| ***B41J 3/28*** | (2006.01) |
| ***B41J 3/36*** | (2006.01) |
| ***B41J 2/01*** | (2006.01) |
| ***B41J 29/38*** | (2006.01) |

(52) U.S. Cl. ..... 400/29; 400/76; 400/23; 400/88; 347/109

(58) Field of Classification Search ..... 400/240, 400/88, 70, 193, 29, 248, 124.1; 347/101, 347/188, 224, 109, 87; 358/451, 296, 171, 358/188, 1.18, 473; 101/486; 345/163, 169, 345/161, 156; 361/681

See application file for complete search history.

(56) References Cited

U.S. PATENT DOCUMENTS

| | | | | |
|---|---|---|---|---|
| 3,993,865 | A * | 11/1976 | Browne et al. | 358/473 |
| 4,196,450 | A * | 4/1980 | Miller et al. | 356/256 |
| 4,675,700 | A | 6/1987 | Nagira et al. | |
| 4,758,849 | A | 7/1988 | Piatt et al. | |
| 4,804,949 | A | 2/1989 | Faulkerson | 345/166 |
| 4,819,083 | A | 4/1989 | Kawai et al. | 358/451 |
| 4,906,843 | A | 3/1990 | Jones et al. | 250/221 |
| 4,915,027 | A | 4/1990 | Ishibashi et al. | |
| 4,933,867 | A | 6/1990 | Ishigaki | |
| 4,947,262 | A | 8/1990 | Yajima et al. | |
| 4,949,391 | A | 8/1990 | Faulkerson et al. | |
| 4,999,016 | A | 3/1991 | Suzuki et al. | |
| 5,013,895 | A | 5/1991 | Iggulden et al. | |
| 5,024,541 | A | 6/1991 | Tsukada et al. | |
| 5,028,934 | A | 7/1991 | Kasai et al. | |
| 5,052,832 | A | 10/1991 | Akiyama et al. | |
| 5,063,451 | A | 11/1991 | Yanagisawa et al. | 346/143 |
| 5,093,675 | A | 3/1992 | Koumura et al. | |
| 5,095,303 | A * | 3/1992 | Clark et al. | 345/164 |
| 5,110,226 | A | 5/1992 | Sherman et al. | |
| 5,111,216 | A | 5/1992 | Richardson et al. | |
| 5,149,980 | A | 9/1992 | Ertel et al. | |

(Continued)

FOREIGN PATENT DOCUMENTS

JP 10283160 A * 10/1998

(Continued)

OTHER PUBLICATIONS

Machine translation of JP 2003131805 to Iida et al. from Japanese Patent Office website.*

*Primary Examiner*—Daniel J Colilla
(74) *Attorney, Agent, or Firm*—Taylor & Aust, PC

(57) ABSTRACT

A hand-operated printer includes a body. A printhead is mounted to the body. A display device is mounted to the body, and a user interface is communicatively coupled to the display device. The user interface provides a user input to the display device that is based on movement of the hand-operated printer.

18 Claims, 5 Drawing Sheets

U.S. PATENT DOCUMENTS 5,160,943 A 11/1992 Pettigrew et al.
5,184,907 A 2/1993 Hamada et al.
5,186,558 A 2/1993 Sherman et al.
5,188,464 A 2/1993 Aaron
5,236,265 A 8/1993 Saito et al.
5,240,334 A 8/1993 Epstein et al.
5,262,804 A 11/1993 Petigrew et al.
5,267,800 A 12/1993 Petteruti et al.
5,308,173 A 5/1994 Amano et al.
5,311,208 A 5/1994 Burger et al.
5,312,196 A 5/1994 Hock et al.
5,344,248 A 9/1994 Schoon et al.
5,355,146 A 10/1994 Chiu et al.
5,446,559 A 8/1995 Birk
5,449,238 A 9/1995 Pham et al.
5,462,375 A 10/1995 Isobe et al.
5,475,403 A 12/1995 Havlovick et al.
5,503,483 A 4/1996 Etteruti et al.
5,520,470 A 5/1996 Willett
5,563,631 A * 10/1996 Masunaga ..... 345/169
5,574,804 A * 11/1996 Olschafskie et al. ..... 382/313
5,578,813 A * 11/1996 Allen et al. ..... 250/208.1
5,593,236 A * 1/1997 Bobry ..... 400/88
5,595,445 A * 1/1997 Bobry ..... 400/88
5,648,812 A * 7/1997 Igarashi ..... 347/262
5,650,820 A 7/1997 Sekine et al.
5,664,139 A 9/1997 Spurlock
5,685,651 A 11/1997 Hayman et al.
5,686,720 A 11/1997 Tullis
5,729,008 A 3/1998 Blalock et al.
5,786,804 A 7/1998 Gordon
5,806,993 A 9/1998 Petterutti et al.
5,816,718 A 10/1998 Poole
5,825,044 A 10/1998 Allen et al.
5,829,893 A 11/1998 Kinoshita et al.
5,842,793 A 12/1998 Katayama et al. ..... 400/88
5,848,849 A 12/1998 Kishi et al.
5,850,243 A 12/1998 Kinoshita et al.
5,853,251 A 12/1998 Imai
5,887,992 A 3/1999 Yamanashi
5,892,523 A 4/1999 Tanaka et al.
5,927,827 A 7/1999 Reuter et al.
5,927,872 A 7/1999 Yamada ..... 400/88
5,953,497 A 9/1999 Kokubo et al.
5,984,455 A 11/1999 Anderson
5,988,900 A 11/1999 Bobry ..... 400/88
5,997,193 A 12/1999 Petterutti et al.
6,004,053 A 12/1999 Petteruti et al.
6,005,681 A 12/1999 Pollard
6,010,257 A 1/2000 Petteruti et al.
6,017,112 A 1/2000 Anderson et al.
6,026,686 A 2/2000 Hattori et al.
6,076,910 A 6/2000 Anderson
6,158,907 A 12/2000 Silverbrook et al.
6,195,475 B1 2/2001 Beausoleil, Jr. et al.
6,203,221 B1 3/2001 Tomasik et al.
6,229,565 B1 * 5/2001 Bobry ..... 348/207.99
6,246,423 B1 6/2001 Suzuki et al.
6,249,360 B1 6/2001 Pollard et al.
6,259,826 B1 7/2001 Pollard et al.
6,270,187 B1 8/2001 Murcia et al.
6,270,271 B1 8/2001 Fujiwara
6,295,390 B1 * 9/2001 Kobayashi et al. ..... 382/313
6,312,124 B1 11/2001 Desormeaux ..... 347/109
6,338,555 B1 1/2002 Hirose
6,347,897 B2 2/2002 Huggins et al.
6,357,939 B1 3/2002 Baron ..... 400/88
6,373,995 B1 4/2002 Mioore
6,394,674 B2 5/2002 Huggins et al.
6,499,840 B2 12/2002 Day et al. ..... 347/100
6,503,005 B1 1/2003 Cockerill et al.
6,533,476 B2 3/2003 Hamisch, Jr. et al.
6,543,893 B2 4/2003 Desormeaux ..... 347/109
6,553,459 B1 4/2003 Silverbrook et al.
6,572,290 B2 6/2003 McCleave et al.
6,604,874 B2 8/2003 Carriere et al.
6,607,316 B1 8/2003 Petteruti et al.
6,609,844 B1 8/2003 Petteruti et al.
6,623,191 B2 9/2003 Huggins et al.
6,626,597 B2 9/2003 Fujiwara
6,628,430 B1 * 9/2003 Silverbrook et al. ..... 358/473
6,641,313 B2 11/2003 Bobry
6,648,528 B2 11/2003 Hardisty et al.
6,652,090 B2 11/2003 Silverbrook
6,674,543 B2 1/2004 Day et al. ..... 358/1.8
6,769,360 B2 8/2004 Walling
6,773,177 B2 8/2004 Denoue et al. ..... 400/88
6,846,119 B2 1/2005 Walling ..... 400/88
6,942,335 B2 9/2005 Trent ..... 347/109
6,952,880 B2 10/2005 Saksa ..... 33/35
6,977,675 B2 * 12/2005 Kotzin ..... 348/208.2
7,138,979 B2 * 11/2006 Robin et al. ..... 345/158
7,170,652 B2 * 1/2007 Silverbrook ..... 358/474
7,180,502 B2 * 2/2007 Marvit et al. ..... 345/156
2001/0019349 A1 9/2001 Kawakami
2001/0022914 A1 9/2001 Iura et al.
2001/0024586 A1 9/2001 Day et al.
2002/0033871 A1 3/2002 Kaiser
2002/0090241 A1 7/2002 Fujiwara
2002/0127041 A1 9/2002 Huggins et al.
2002/0154186 A1 10/2002 Matsumoto
2003/0031494 A1 2/2003 Cockerill et al.
2003/0063938 A1 4/2003 Hardisty et al.
2003/0117456 A1 6/2003 Silverbrook et al.
2003/0221081 A1 * 11/2003 Torres ..... 711/171
2004/0009024 A1 1/2004 Hardisty et al.
2004/0014468 A1 1/2004 Walling
2004/0018035 A1 1/2004 Petteruti et al.
2004/0027330 A1 * 2/2004 Bradski ..... 345/158
2004/0239982 A1 * 12/2004 Gignac ..... 358/1.15
2005/0012805 A1 * 1/2005 Silverbrook ..... 347/109
2005/0017453 A1 * 1/2005 Rehbein et al. ..... 273/299
2005/0018032 A1 1/2005 Walling
2005/0018033 A1 1/2005 Walling
2005/0057508 A1 * 3/2005 Kim ..... 345/163
2006/0007151 A1 * 1/2006 Ram ..... 345/163
2006/0012660 A1 1/2006 Dagborn
2006/0050131 A1 3/2006 Breton
2006/0061647 A1 3/2006 Breton
2006/0119911 A1 * 6/2006 Narusawa ..... 358/527
2006/0165460 A1 * 7/2006 Breton ..... 400/88
2007/0024578 A1 * 2/2007 Lundquist ..... 345/156

FOREIGN PATENT DOCUMENTS

JP 2000075986 A * 3/2000
JP 2001121780 A * 5/2001
JP 2003131805 A * 5/2003
JP 2004234587 A * 8/2004

* cited by examiner

USER INTERFACE FOR A HAND-OPERATED PRINTER

BACKGROUND OF THE INVENTION

1. Field of the Invention

The present invention relates to a hand-operated printer, and, more particularly, to a user interface for a hand-operated printer.

2. Description of the Related Art

Typical desktop ink jet printers include a reciprocating printhead carrier that carries a printhead in a main scan direction, and includes a drive roller assembly that advances a print medium in a sub-scan direction relative to the printhead. Such ink jet printers typically require user interaction in some form. For example, one such desktop ink jet printer may utilize a host computer in making selections, adjusting parameters, etc. Such an ink jet printer also may include one or more input buttons.

In contrast to desktop printers, a hand-operated printer, also sometimes referred to as a hand held printer, is a printer that typically does not include a drive mechanism for positioning a printhead relative to the print medium, such as paper. An optical encoder typically is used to provide position feedback of relative motion between the hand-operated printer and the print medium.

SUMMARY OF THE INVENTION

The invention, in one exemplary embodiment, is directed to a hand-operated printer. The hand-operated printer includes a body, a printhead mounted to the body, a display device mounted to the body, and a user interface communicatively coupled to the display device. The user interface provides a user input to the display device based on movement of the hand-operated printer.

The invention, in another exemplary embodiment, is directed to a hand-operated printer. The hand-operated printer includes a body; a printhead mounted to the body; a position encoder mounted to the body; and a display device mounted to the body. The position encoder is communicatively coupled to the display device to provide a user interface with the display device.

The invention, in another exemplary embodiment, is directed to a hand-operated printer including a body. A printhead, a position encoder and a display device is mounted to the body. The position encoder is configured to sense a movement of the hand-operated printer. The display device displays a plurality of items and a selection icon. A controller is communicatively coupled to each of the printhead, the position encoder, and the display device. The controller communicatively couples the position encoder to the display device. The position encoder provides a user interface with the display device to accommodate a selection of an item from the plurality of items by a manipulation of a position of the selection icon when the position encoder senses the movement of the hand-operated printer.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention, and such exemplifications are not to be construed as limiting the scope of the invention in any manner.

DETAILED DESCRIPTION OF THE INVENTION

Figure 1:
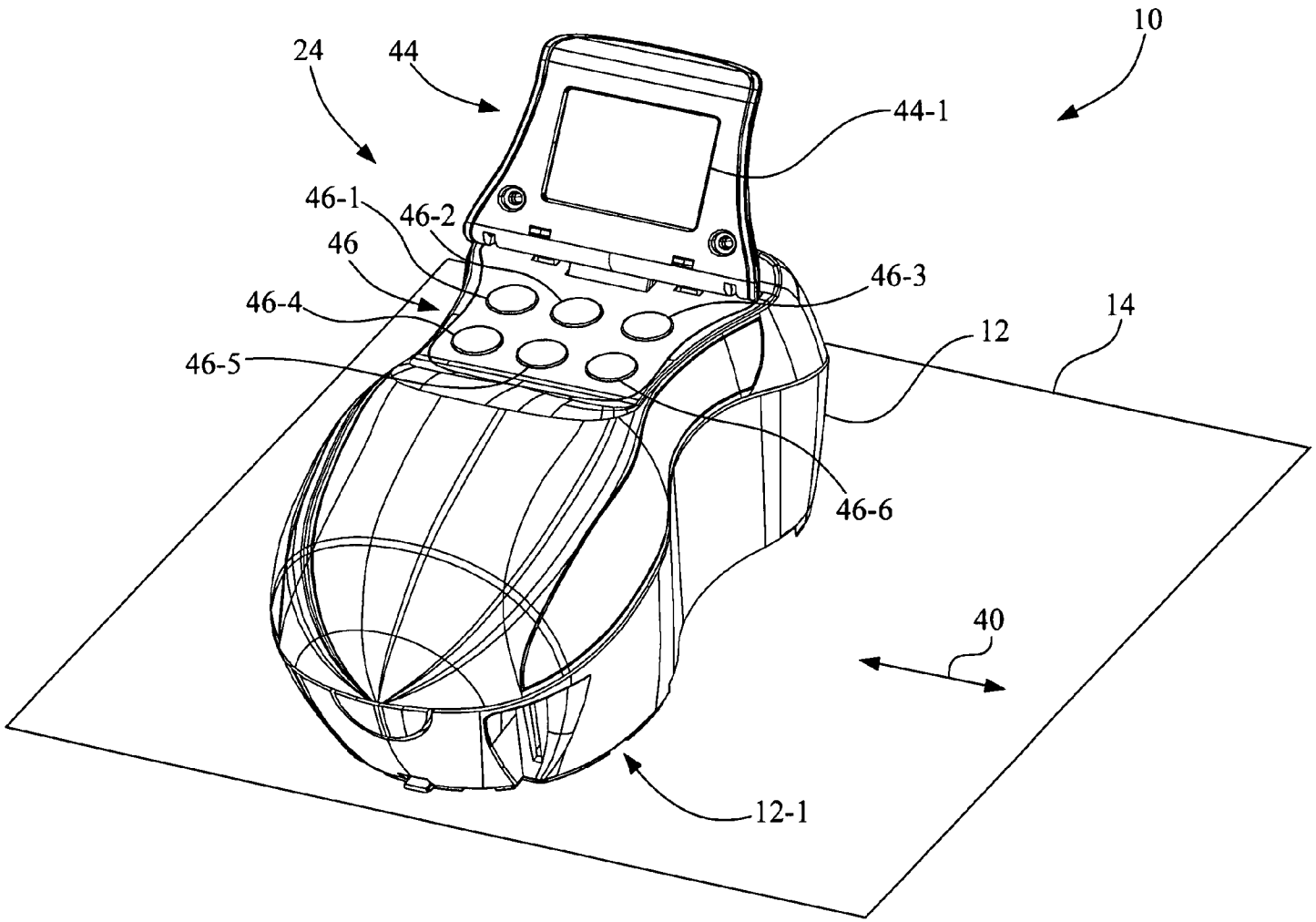
FIG. 1 is a perspective view of a hand-operated printer in accordance with an embodiment of the present invention.

Referring now to the drawings and particularly to FIG. 1, there is shown a perspective view of a hand-operated printer 10. Hand-operated printer 10 includes a body 12. Body 12 is configured with a smooth surface 12-1 that contacts a print medium 14, such as for example, a sheet of paper, transparency, card stock, fabric, hard surface, soft surface, etc. During operation, a user provides the motive force to provide movement of hand-operated printer 10 relative to print medium 14.

Figure 2:
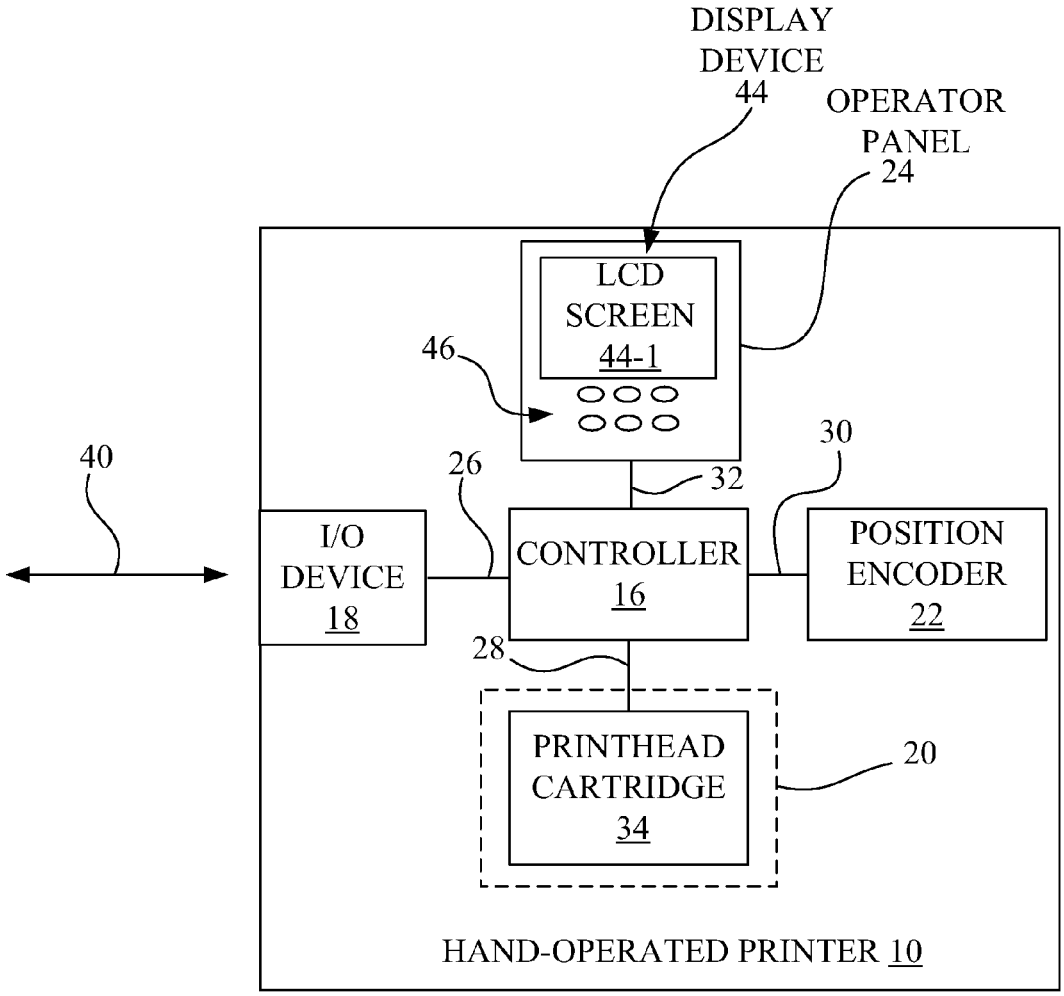
FIG. 2 is a general diagrammatic representation of the hand-operated printer of FIG. 1.

FIG. 2 is a general diagrammatic representation of hand-operated printer 10. Hand-operated printer 10 may be, for example, a hand-operated ink jet printer, and may include a controller 16, an input/output (I/O) device 18, a printhead cartridge receptacle 20, a position encoder 22, and an operator panel 24. Each of controller 16, I/O device 18, cartridge receptacle 20, position encoder 22, and operator panel 24 are mounted to body 12.

Controller 16 includes a processor unit and associated memory, and may be formed as one or more Application Specific Integrated Circuits (ASIC). Controller 16 executes program instructions to perform data processing and formatting, facilitate device control, and/or facilitate device interaction with respect to a plurality of devices in communication with controller 16. Controller 16 is communicatively coupled to I/O device 18 via communications link 26. Controller 16 is communicatively coupled to cartridge receptacle 20 via a communications link 28. Controller 16 is communicatively coupled to position encoder 22 via a communications link 30. Controller 16 is communicatively coupled to operator panel 24 via communications link 32. As used herein, the term "communications link" generally refers to structure that facilitates electronic communication between components, and may operate using wired or wireless technology.

I/O device 18 may be configured in a variety of ways, depending on the source and/or destination of the communicated content. For example, I/O device 18 may be a wired or wireless communication device that provides a communications link to a host computer, or some other intelligent device, that may supply image data for printing by hand-operated printer 10. Alternatively, I/O device 18 may be a local source of image content, such as for example, a memory card reader and associated memory card.

Figure 3:
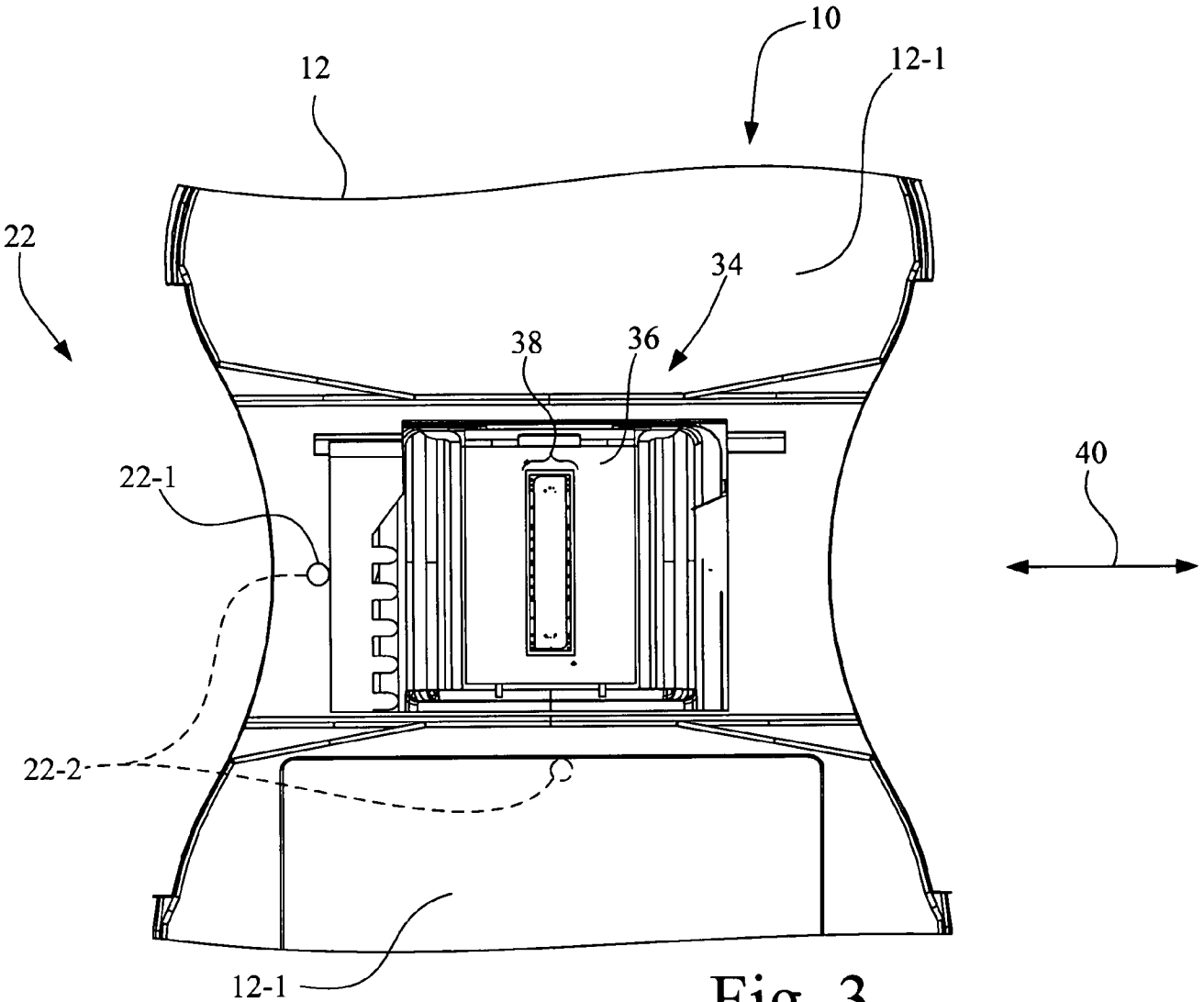
FIG. 3 is a bottom view of an embodiment of the hand-operated printer of FIG. 1.

Cartridge receptacle 20, for example, may be formed in body 12 and configured for receiving and mounting at least one printhead cartridge 34. Cartridge receptacle 20 holds printhead cartridge 34 in a fixed position relative to hand-operated printer 10. Printhead cartridge 34 is communicatively coupled to controller 16 via communications link 28. As shown in the example of FIG. 3, printhead cartridge 34 includes a printhead 36 including an array of ink jetting nozzles 38. Printhead cartridge 34 further includes a supply of ink.

Movement of the hand-operated printer 10 relative to print medium 14 along a scan axis 40 results in relative movement of printhead cartridge 34 and printhead 36 with respect to a printing surface of print medium 14 along scan axis 40. The term "scan axis" is used for convenience, and is intended to include both linear and non-linear movement of hand-operated printer 10. The smooth surface 12-1 of body 12 contacts print medium 14 to provide the desired spacing between printhead 36 and the printing surface of print medium 14.

Position encoder 22 may be an optical encoder positioned on the underside of hand-operated printer 10, as shown in FIG. 3, and may be configured to sense movement in one or more directions so to determine a position relative to print medium 14, e.g., a print position. Position encoder 22 may include for example, a one dimensional sensor unit 22-1, or alternatively as represented in dashed lines, a two-dimensional sensor unit 22-2. Each of sensor unit 22-1 and sensor unit 22-2 detects movement of hand-operated printer 10 by sensing small changes in the surface features, e.g., roughness, of print medium 14. Each of sensor units 22-1, 22-2 may be, for example, a unitary optical sensor including a light source and a detector, each positioned to establish an angle of incidence, e.g., angle of reflection, with respect to print medium 14. Each light source may include, for example, a light emitting diode (LED) emitting a predetermined color of light, and each detector may be, for example, a phototransistor whose voltage, or current, output varies as a function of the intensity of the reflected light that it receives.

As shown in FIGS. 1 and 2, operator panel 24 includes a display device 44, coupled by hinges to body 12, and a plurality of control buttons 46. Display device 44 and control buttons 46 are communicatively coupled to controller 16 via communications link 32. Display device 44 may include, for example, a liquid crystal display (LCD) screen 44-1 having, for example, a resolution (height x width) of 81×101 pixels. Control buttons 46 may include, for example, a POWER button 46-1, a PRINT button 46-2, a MENU button 46-3, a SELECT button 46-4, a CANCEL button 46-5, and a DRAW button 46-6. Of course, the number of buttons used may deviate from that used in the exemplary embodiment of hand-operated printer 10 shown in FIG. 1, depending on the actual configuration of the hand-operated printer and the applications for which the hand-operated printer may be used.

Hand-operated printer 10 is powered-up, for example, by pressing POWER button 46-1. If, for example, a user desires to print an image, such as an image displayed on display device 44, then PRINT button 46-2 is actuated, e.g., pressed, and the user manually moves hand-operated printer 10 relative to print medium 14 along scan axis 40. Controller 16 controls printhead 36 to print an image on print medium 14 corresponding to the image selection made. A distance of movement of hand-operated printer 10 in at least one direction is automatically sensed by position encoder 22, and printing will commence forming an image on print medium 14 after hand-operated printer 10 has moved a predetermined distance to reach a designated print position.

In accordance with the present invention, position encoder 22 is communicatively coupled to display device 44, e.g., via controller 16, to provide a user interface with display device 44. In other words, the user utilizes the position sensing capability of position encoder 22 to make selections from a plurality of selectable items displayed on display device 44 of hand-operated printer 10.

If, for example, position encoder 22 includes one-dimensional sensor unit 22-1, wherein positioning only is known along one dimension, e.g., along scan axis 40, then the user input via position encoder 22 will be akin to a linear scale. Such an input may be used, for example, to scroll through menu choices or images/photos, or it can be used to adjust an image property, such as brightness or size. Such an interface may also scroll through individual letters, numbers, or other characters such that after a string of these are selected, hand-operated printer 10 can print the chosen characters.

Consider, for example, that display device 44 displays a plurality of items and a selection icon. As used herein, the term "selection icon" refers to any designation on display device 44 to indicate a selection of a particular item. Examples of such a selection icon include a highlight, a cursor, a pointer, etc. Accordingly, the one-dimensional sensor unit 22-1 of position encoder 22 senses a movement of hand-operated printer 10 and accommodates a selection from the plurality of items displayed by display device 44 by a sequential manipulation of a position of the selection icon, such as the highlight shown in FIG. 4. In a sequential manipulation of the position of the selection icon, the selection icon moves in a series path from a current item to a next or previous item, although the arrangement of the items displayed need not be limited to a linear list of the items.

Figure 4:
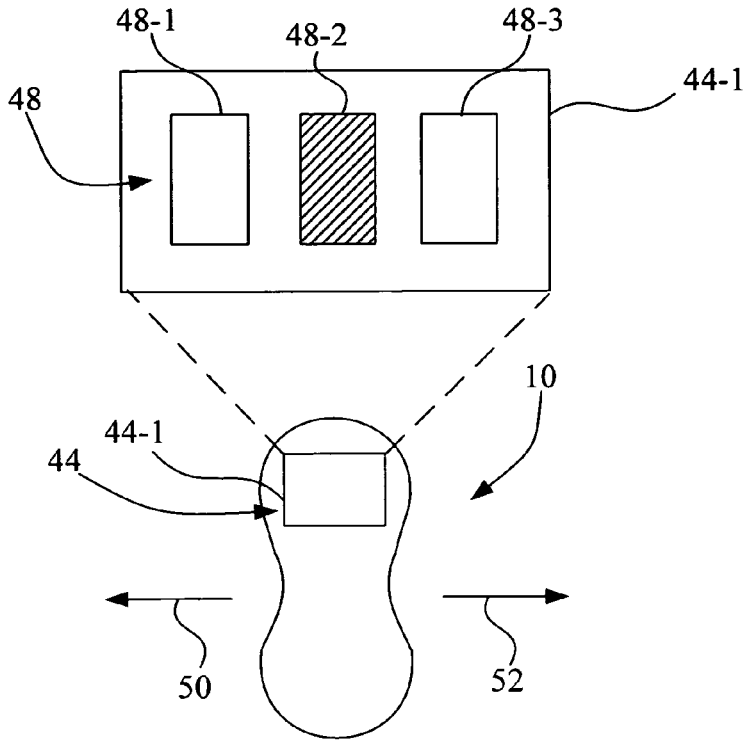
FIG. 4 illustrates an exemplary linear sequence of selectable items displayed on a display device of the hand-operated printer of FIG. 1.

In the example of FIG. 4, LCD screen 44-1 of display device 44 is shown projected and enlarged to aid the reader in viewing and understanding the present invention.

FIG. 4 shows an exemplary display generated on display device 44, wherein a linear sequence of a plurality of thumbnail images 48 is shown, and individually identified as thumbnail images 48-1, 48-2 and 48-3. If, for example, at the current position of hand-operated printer 10 thumbnail image 48-2 is highlighted to indicate its current selection, and the user desires to select thumbnail image 48-1, then the user may move hand-operated printer in direction 50 relative to a surface, such as print medium 14, until thumbnail image 48-1 is highlighted. If, for example, at the current position of hand-operated printer 10 thumbnail image 48-2 is highlighted to indicate its current selection, and the user desires to select thumbnail image 48-3, then the user may move hand-operated printer in direction 52 relative to a surface, such as print medium 14, until thumbnail image 48-3 is highlighted. During this process, position encoder 22 provides a user interface input in the form of position change information of hand-operated printer 10 to controller 16, and in turn, to display device 44, and display device 44 is updated to reflect the new current selection. To confirm the selection, the user actuates, e.g., presses, SELECT button 46-4 (see FIG. 1). If the user decides against the selection, then CANCEL button 46-5 is actuated, e.g., pressed. If the user then wants to print the selection, the PRINT button 46-2 is actuated, e.g., pressed and held, and the user moves hand-operated printer 10 in the desired print direction.

Figure 5:
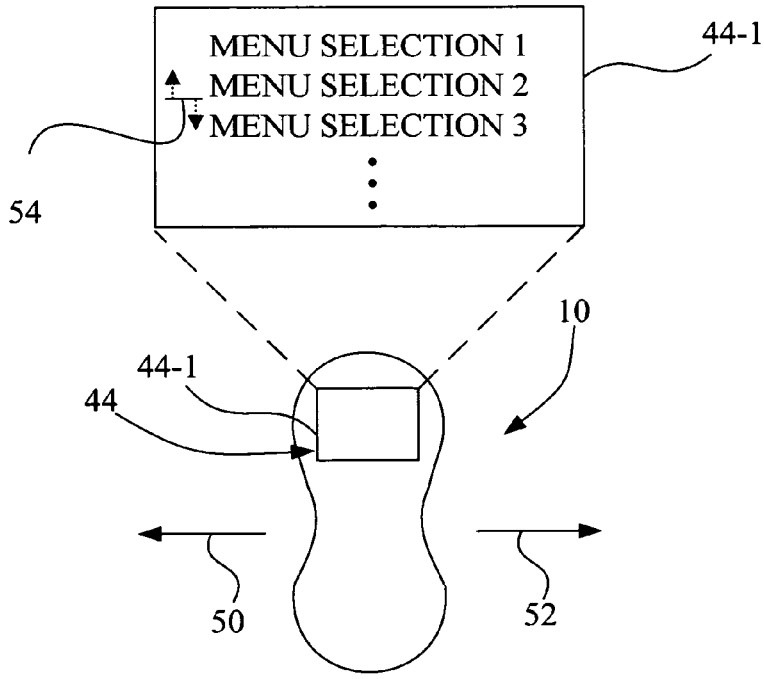
FIG. 5 illustrates an exemplary list of menu options displayed on a display device of the hand-operated printer of FIG. 1.

Another example is illustrated in FIG. 5. In the example of FIG. 5, LCD screen 44-1 of display device 44 is shown projected and enlarged to aid the reader in viewing and understanding the present invention.

As illustrated in FIG. 5, if the user wants to select from a plurality of menu options, then the user may select to display a menu screen on display device 44 by pressing the MENU button 46-3. Then, in accordance with the present invention, the user may move the selection icon, such as a cursor 54, to scroll through the menu options, e.g., up or down, to select a desired menu choice by moving hand-operated printer 10 relative to a surface, such as print medium 14. During this process, position encoder 22 provides a user interface input in the form of position change information of hand-operated printer 10 to controller 16, and in turn, to display device 44, and display device 44 is updated to show the new position of cursor 54. Once the desired selection is displayed on display device 44, the user actuates, e.g., presses, the SELECT button 46-4 to confirm the selection.

Figure 6:
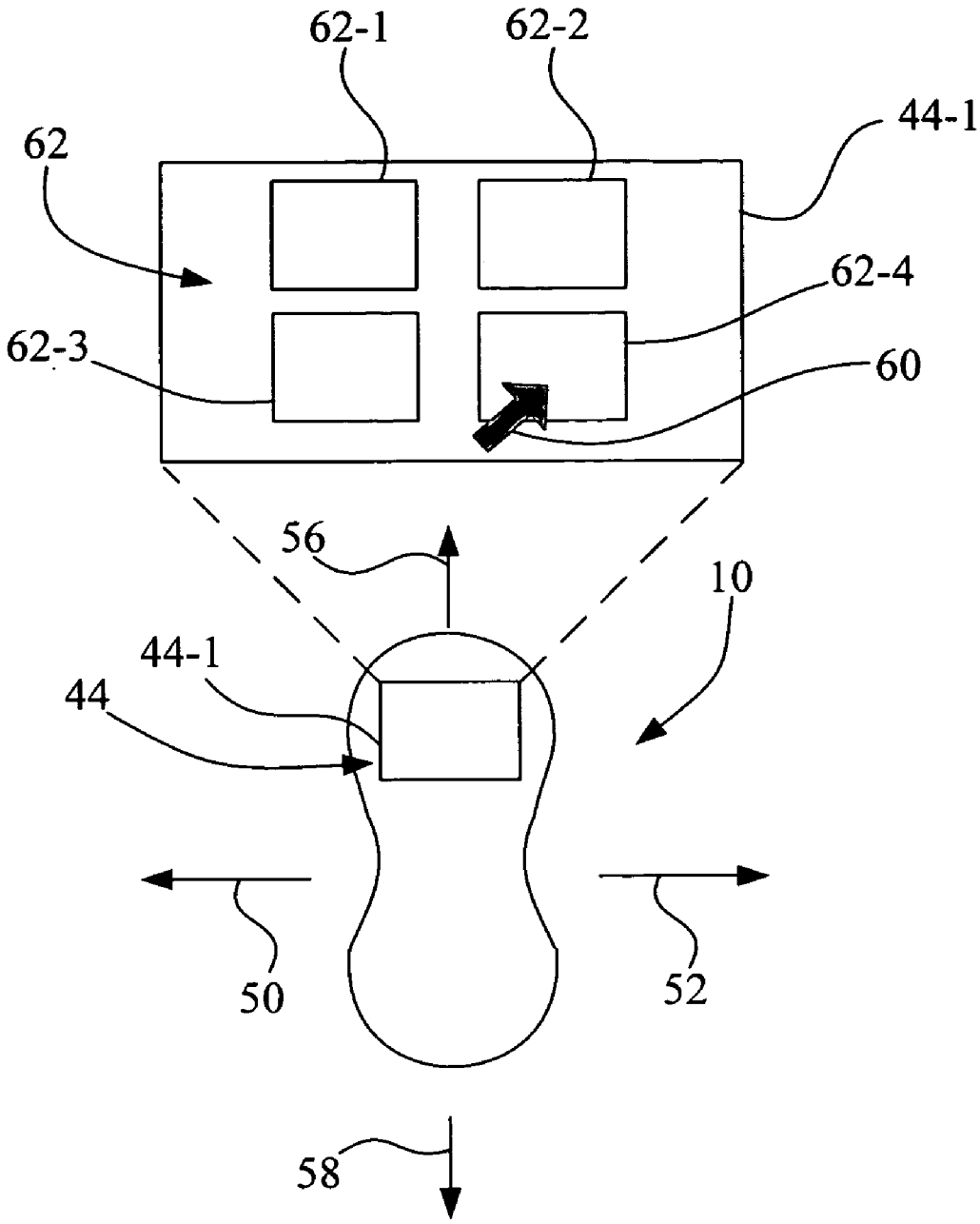
FIG. 6 illustrates an exemplary two-dimensional array of selectable items displayed on a display device of the hand-operated printer of FIG. 1.

Alternatively, position encoder 22 may include two-dimensional sensor unit 22-2, wherein the relative position of hand-operated printer 10 is known in orthogonal directions 50, 52, 56, 58, as illustrated in FIG. 6. In the example of FIG. 6, LCD screen 44-1 of display device 44 is shown projected and enlarged to aid the reader in viewing and understanding the present invention.

Consider, for example, that display device 44 displays a plurality of items and a selection icon. Accordingly, the two-dimensional sensor unit 22-2 of position encoder 22 senses a movement of hand-operated printer 10 and accommodates a selection from the plurality of items displayed by display device 44 by either of a sequential manipulation or a two-dimensional manipulation of a position of the selection icon, such as a pointer 60 shown in FIG. 6.

As illustrated in FIG. 6, for example, a two dimensional array of a plurality of items 62, such as images 62-1, 62-2, 62-3 and 62-4, may be displayed by display device 44. Also, pointer 60 may be present on display device 44 and may be moved in directions 50, 52, 56, 58, or in combinations thereof to simulate motions in other directions, such as diagonal, curved, or other linear or non-linear motions. With position encoder 22 sensing movement of hand-operated printer 10, the user is able to move pointer 60 by moving hand-operated printer 10 in order to select a displayed item, such as an image 62-4 from the two-dimensional array of items 62 as shown in this example. Alternatively, the user may make selections from other displayed items, such as selecting a button from a plurality of on-screen buttons, characters from an on-screen keyboard for text entry, or anything else that is selectable on display device 44.

The two-dimensional interface may also be used to select a crop area on an image to be printed. In addition, the user may use the pointer to draw a figure on display device 44 (including a signature) by actuating DRAW button 46-6, and then manipulating the position of hand-operated printer 10 to draw an object or line. Also, such drawing input may be interpreted as characters or commands, if desired.

While this invention has been described with respect to embodiments of the invention, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A hand-operated printer, comprising:

a body;

a printhead mounted to said body;

a display device mounted to said body; and a user interface communicatively coupled to said display device and configured with a position encoder to sense movement of said hand-operated printer, said user interface providing a user input to said display device based on movement of said hand-operated printer sensed by said position encoder, wherein:

said display device displays a plurality of thumbnail images and a selection icon; and said user interface is configured to accommodate a selection of an image to be printed from said plurality of thumbnail images by a manipulation of a position of said selection icon based on a first movement of said hand-operated printer sensed by said position encoder, and wherein said hand-operated printer commences printing said selection on a print medium, based on a second movement of said hand-operated printer detected by said position encoder, after said hand-operated printer has moved a predetermined distance to a designated print position.

2. The hand-operated printer of claim 1, said user interface including:

a controller communicatively coupling said position encoder to said display device.

3. The hand-operated printer of claim 1, wherein said position encoder includes a one-dimensional sensor unit to accommodate said selection of said image to be printed from said plurality of thumbnail images by a sequential manipulation of a position of said selection icon.

4. The hand-operated printer of claim 3, wherein said position encoder is an optical encoder.

5. The hand-operated printer of claim 3, wherein said display device includes a LCD screen.

6. The hand-operated printer of claim 1, wherein:

said position encoder includes a two-dimensional sensor unit to accommodate said selection of said image to be printed from said plurality of thumbnail images by a sequential manipulation or a two-dimensional manipulation of a position of said selection icon.

7. The hand-operated printer of claim 1, wherein said display device displays said image to be printed and said user interface being configured to select a crop area of said image of said plurality of thumbnail images that is selected to be printed.

8. A hand-operated printer, comprising:

a body;

a printhead mounted to said body;

a display device mounted to said body; and a user interface communicatively coupled to said display device, said user interface providing a user input to said display device based on movement of said hand-operated printer, said user interface including a position encoder configured to sense a movement of said hand-operated printer and a controller communicatively coupling said position encoder to said display device, wherein said display device displays an icon for performing drawing based on a first movement of said hand-operated printer detected by said position encoder, and during a printing operation commence printing said drawing on a print medium, based on a second movement of said hand-operated printer detected by said position encoder, after said hand-operated printer has moved a predetermined distance to a designated print position.

9. A hand-operated printer, comprising:

a body;

a printhead mounted to said body;

a position encoder mounted to said body;

a display device mounted to said body, said position encoder being communicatively coupled to said display device to provide a user interface with said display device; and a controller, said controller communicatively coupling said position encoder to said display device, said display device displays a plurality of thumbnail images and a selection icon; and said position encoder being configured to sense a first movement of said hand-operated printer detected by said position encoder to accommodate a selection of an image to be printed from said plurality of thumbnail images by a manipulation of a position of said selection icon, and wherein said hand-operated printer commences printing said selection on a print medium based on a second movement of said hand-operated printer detected by said position encoder, after said hand-operated printer has moved a predetermined distance to a designated print position.

10. The hand-operated printer of claim 9, further comprising a plurality of buttons communicatively coupled to said controller, said plurality of buttons including a select button which when actuated confirms a selection made from said plurality of thumbnail images via said selection icon.

11. The hand-operated printer of claim 10, wherein said plurality of buttons includes a print button, and said controller controls said printhead to print said image on a print medium corresponding to said selection made, when said print button is actuated.

12. A hand-operated printer, comprising:

a body;

a printhead mounted to said body;

a position encoder mounted to said body, said position encoder being configured to sense a movement of said hand-operated printer;

a display device mounted to said body, said display device displaying a plurality of thumbnail images and a selection icon; and a controller communicatively coupled to each of said printhead, said position encoder, and said display device, said controller communicatively coupling said position encoder to said display device, said position encoder providing a user interface with said display device to accommodate a selection of an image to be printed from said plurality of thumbnail images by a manipulation of a position of said selection icon when said position encoder senses a first movement of said hand-operated printer, and wherein said hand-operated printer commences printing said selection on a print medium based on a second movement of said hand-operated printer detected by said position encoder, after said hand-operated printer has moved a predetermined distance to a designated print position.

13. The hand-operated printer of claim 12, wherein said position encoder includes a one-dimensional sensor unit to sense said movement of said hand-operated printer to accommodate said selection of said image to be printed from said plurality of thumbnail images by a sequential manipulation of a position of said selection icon.

14. The hand-operated printer of claim 12, wherein said position encoder includes a two-dimensional sensor unit to sense said movement of said hand-operated printer to accommodate said selection of said image to be printed from said plurality of thumbnail images by a sequential manipulation or a two-dimensional manipulation of a position of said selection icon.

15. The hand-operated printer of claim 12, wherein said position encoder is an optical encoder.

16. The hand-operated printer of claim 12, further comprising a plurality of buttons communicatively coupled to said controller, said plurality of buttons including a select button which when actuated confirms a selection made from said plurality of thumbnail images via said selection icon.

17. The hand-operated printer of claim 16, wherein said plurality of buttons includes a print button, and said controller controls said printhead to print said image on a print medium corresponding to said selection made, when said print button is actuated.

18. A hand-operated printer, comprising:

a body;

a user input device coupled to said body, said user input device including a print button and a select button;

a printhead mounted to said body;

a display device mounted to said body displaying a plurality of images, a position encoder mounted to said body, said position encoder being configured to sense a movement of said hand-operated printer; and a controller communicatively coupled to each of said user input device, said printhead, said position encoder, and said display device, said controller making an operation selection based on an input from said user input device of:

using said position encoder when said select button is actuated to provide a user interface with said display device to select an image of said plurality of images to be printed, and using the same said position encoder when said print button is actuated to control said printhead to commence printing said image on a print medium after said hand-operated printer has moved a predetermined distance to a designated print position.

* * * * *